US005350208A

United States Patent [19]

Heinrichson

[11] Patent Number: 5,350,208

[45] Date of Patent: Sep. 27, 1994

[54] ANIMAL WASTE PICKUP AND DISPOSAL UNIT

[76] Inventor: Dante C. Heinrichson, 3 Hearthstone Dr., Kinnelon, N.J. 07405

[21] Appl. No.: 165,600

[22] Filed: Dec. 13, 1993

[51] Int. Cl.[5] ..... A01K 29/00; E01H 1/12

[52] U.S. Cl. ..... 294/1.4

[58] Field of Search ..... 294/1.3–1.5, 294/19.1, 22, 50.8, 50.9, 55, 115, 117; 15/104.8, 257.1, 257.4, 257.6, 257.7

[56] References Cited

U.S. PATENT DOCUMENTS

| | | | |
|---|---|---|---|
| 3,328,066 | 6/1967 | Johnston | 294/1.4 X |
| 3,716,263 | 2/1973 | Gatti | 294/1.4 |
| 4,194,777 | 3/1980 | Carns | 294/1.4 |
| 4,210,351 | 7/1980 | Orofino | 294/1.4 X |
| 4,477,111 | 10/1984 | Crooks | 294/1.4 |

FOREIGN PATENT DOCUMENTS

| | | | |
|---|---|---|---|
| 2069 | 5/1979 | European Pat. Off. | 294/1.4 |
| 2457526 | 6/1976 | Fed. Rep. of Germany | 294/1.4 |
| 2505898 | 11/1982 | France | 294/1.3 |

*Primary Examiner*—Johnny D. Cherry
*Attorney, Agent, or Firm*—Alfred C. Hill

[57] ABSTRACT

An animal waste pickup and disposal unit comprising a pair of opposed jaws each movable toward each other; a plastic bag removably disposed between the pair of jaws having material adjacent an open end thereof folded back over an outer surface of the pair of jaws; an arrangement disposed on the outer surface of each of the pair of jaws to releasably secure the material of the bag to the outer surface of the pair of jaws; an elongated handle; and another arrangement secured to each of the pair of jaws and the handle to bias the pair of jaws in an open position and to actuate each of the pair of jaws to enable picking up animal waste and depositing the same in the plastic bag for disposal at a later time.

8 Claims, 1 Drawing Sheet

ANIMAL WASTE PICKUP AND DISPOSAL UNIT

BACKGROUND OF THE INVENTION

The present invention relates to refuse collecting devices and more particularly to a device for the removal and disposal of animal droppings or excreted solid materials, particularly those of dogs and cats in such places as gardens and lawns and on or along sidewalks and other public places as well as indoors.

Currently there is much adverse criticism of dog owners for permitting their animals to deposit their droppings in public places and on the property of other persons. In some geographical places, legislation has been enacted requiring a dog owner not only to clean up after his or her pet in any public area, but also actually to carry an approved device for performing the pickup task. Effective retrieval of animal waste deposits and particularly dog feces has been a matter of considerable concern due to possible risk to public health created by resultant unsanitary conditions not to mentioned the general inconvenience to the public.

To combat this problem, many different types of refuse collecting devices have been devised other that the usual dust pan, brooms or trowels which have long been used for clean-up purposes. The most satisfactory of these devices are such that they may be operated with one hand and without necessitating bending over or stooping to the end that the accompanying leashed animal may be securely held with the other hand. In general, such devices are of two distinctive types, the first type including a device having cooperating jaws at the lower end of a relatively long cane-like handle, together with a hand or foot-operated member by means of which the jaws may be actuated. The other type includes a scoop arrangement which is forcibly slid underneath a given dropping and some of these devices have associated therewith a paddle-like closure which is moveable in a reverse direction toward the edge of the scoop in order to pull the excretement or refuse into the scoop if the dislodged material does not fully overly the scoop at the time an attempt is made to pick it up. With both of these types, some of the devices make provisions for collecting the refuse matter in an open refuse bag, the refuse material entering the open end of the bag in the usual manner of a bag-filling operation, thus soiling the open rim region of the bag where it is subsequently tied as a preliminary to disposal of the bag and its contents.

U.S. Pat. Nos. 3,912,316; 4,014,584; 4,097,082; 4,194,777 and 4,225,174 disclose examples of prior art devices for removal and disposal of animal droppings. None of these prior art devices enable multiple pickup of animal waste. Nor do any of the devices of these prior art patents or those patents made of record therein disclose a spring clip arrangement for holding the plastic bag or refuse bag in place in the jaw mechanism of these prior art devices. In addition, some of these prior art devices such as disclosed in U.S. Pat. No. 4,014,584 require a two hand operation thereby failing to permit the operator to control the dog on a leash.

SUMMARY OF THE INVENTION

An object of the present invention is to provide an animal waste pickup and disposal unit capable of one handed operation.

Another object of the present invention is to provide an animal waste pickup and disposal unit containing a plastic bag for receiving the animal waste which is releasably secured to the outer surface of the pair of jaws of the device.

A further object of the present invention is the provision of an animal waste pickup and disposal unit capable of picking up a plurality of animal waste deposits without losing previously picked up animal waste deposits.

A feature of the present invention is the provision of an animal waste pickup and disposal unit comprising a pair of opposed jaws each moveable toward each other; a plastic bag removably disposed between the pair of jaws having material adjacent an open end thereof folded back over an outer surface of the pair of jaws; first means disposed on the outer surface of each of the pair of jaws to releasably secure the material of the plastic bag to the outer surface of the pair of jaws; an elongated handle; and second means secured to each of the pair of jaws and the handle to bias the pair of jaws in an open .position and to actuate each of the pair of jaws to enable picking up animal waste and depositing the same in the plastic bag for disposal at a later time.

Another feature of the present invention is the provision of an animal waste pickup and disposal unit as above defined further including a baffle member secured to one of the pair of jaws extending toward but spaced from the other of the pair of jaws to enable picking up and depositing in the plastic bag a plurality of animal waste deposits without previously picked up and deposited animal waste deposits falling out of the plastic bag.

BRIEF DESCRIPTION OF THE DRAWING

Above-mentioned and other features and objects of the present invention will become more apparent by reference to the following description taken in conjunction with the accompanying drawing, in which.

DESCRIPTION OF THE PREFERRED EMBODIMENTS

Figure 2:
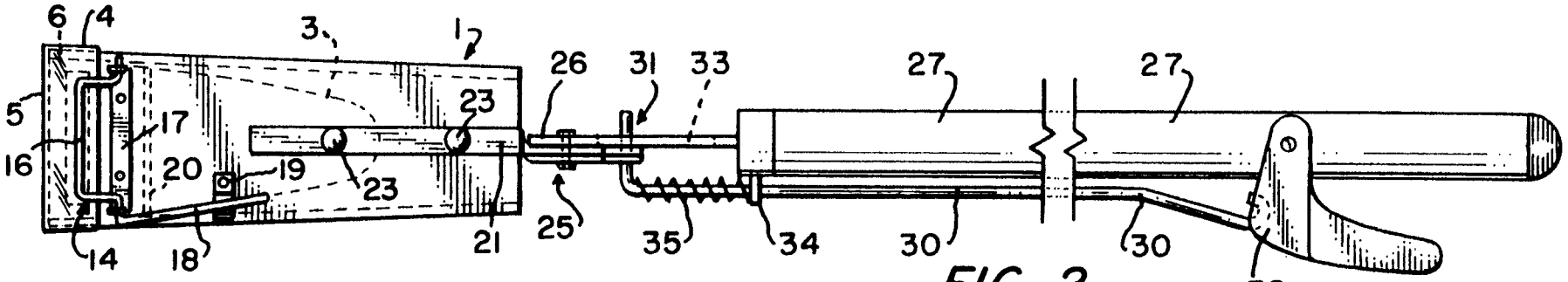
FIG. 2 is a top view of the animal waste pickup and disposal unit of FIG. 1 showing one embodiment of the spring clip arrangement for holding the plastic bag in position within the jaws of the unit of the present invention.
Figure 1:
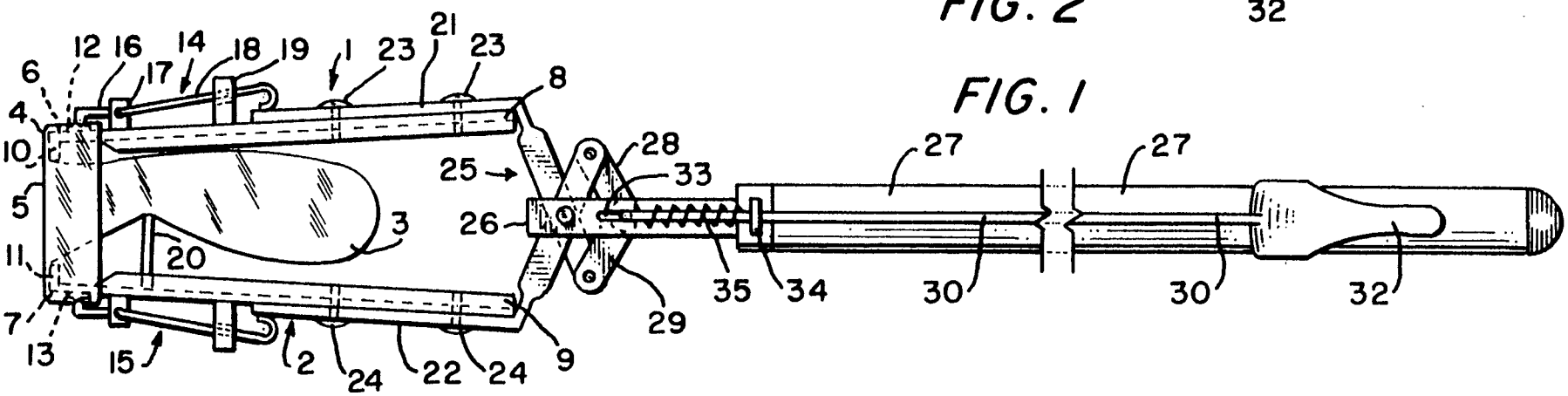
FIG. 1 is a side view of an animal waste pickup and disposal unit in accordance with the principles of the present invention.

Referring to FIGS. 1 and 2, the animal waste pickup and disposal unit in accordance with the principles of the present invention includes a pair of opposed jaws 1 and 2 each moveable toward one another and a plastic bag 3 removably disposed between jaws 1 and 2 having material 4 adjacent the open end 5 of the plastic bag 3 folded back over an outer surface 6 and 7 of jaws 1 and 2.

Jaws 1 and 2 each have a pair of lips 8 and 9 to stiffen the material thereof. Jaw 1 has a lip 10 and jaw 2 has a lip 11 to assist in picking up the animal waste.

Each of jaws 1 and 2 has a roughened surface on the outer surfaces 6 and 7, such as surfaces 12 and 13, which may be in the form of sandpaper or merely roughening the surface 6 and 7. The material 4 of bag 3 is positioned on the roughened surfaces 12 and 13 and held against this surface by spring clips 14 and 15. Spring clip 14 includes a spring wire 16 pivotably mounted in bracket 17 with the continuation 18 of spring wire 16 being forced upwardly to engage member 19 to thereby provide a downward force on material 4 of bag 3 by member 16 to hold the material 4 of bag 3 in position. The spring clip 15 on jaw 2 is identical to that just described with respect to spring clip 14 associated with jaw 1. When it is desired to release material 4 of bag 3 for disposal, member 18 is released from member 19 to release the spring tension provided by member 16 on the material 4 of bag 3. The roughened surfaces 12 and 13 prevent the material 4 of bag 3 from being pulled from underneath the member 16 when the unit is in use.

To facilitate the picking up a plurality of animal waste deposits without spilling from bag 3 previously picked up animal waste deposits, a baffle 20 is provided extending from one of the jaws, such as jaw 2, toward jaw 1 but in a space relation thereto so that when an animal waste deposit is picked up and deposited in bag 3, the picked up deposit is placed in bag 3 on the side of baffle 20 remote from the opening 5 of the bag to thereby prevent the animal waste dropping from falling out of the bag when a subsequent animal waste dropping is picked up by jaws 1 and 2 for deposit in bag 3.

Members 21 and 22 are respectively fastened to jaws 1 and 2 by welding, rivets or nuts and bolts, such as the rivets 23 and 24 shown in FIGS. 1 and 2. Members 21 and 22 extend beyond the surface of jaws 1 and 2 and are twisted to become parallel to each other as shown at 25. The members at area 25 are pivotably connected to member 26 extending from elongated handle 27. Members 21 and 22 are pivotably connected to members 28 and 29 which are pivotably arranged with respect to actuation rod 30 at 31. This arrangement provides a scissor mechanism and when actuating rod 30 is actuated by actuator 32 connected to handle 27, portion 31 of actuating rod 30 will slide in the slot 33 of member 26. Rod 30 is guided in guide 34 fastened to handle 27 which also acts as a stop for return spring 35 which acts to bias jaws 1 and 2 in the open position. Actuator 32 actuates rod 30 to operate the scissor mechanism to close jaws 1 and 2 when it is desired to pickup animal waste droppings and once picked up by lips 10 and 11 of jaws 1 and 2, the whole unit is raised to deposit the animal waste droppings in bag 3 on the side of baffle 20 remote from the opening 5 of bag 3 so that multiple pickups of animal waste droppings can be accomplished without the previously picked up animal waste droppings falling out of bag 3.

The material for jaws 1 and 2 can be sheet metal or a suitable plastic. The material should be lightweight but yet rigid enough so as to accomplish the desired task.

Once the animal waste has been picked up and deposited in bag 3 on the side of baffle 20 remote from opening 5 of bag 3, the spring clips 14 nd 15 can be released and the bag 3 tied off for disposal in a suitable refuse container.

Figure 3:
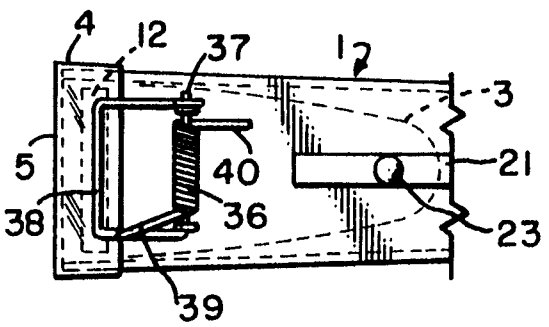
FIG. 3 is a partial top view of an animal waste pickup and disposal unit in accordance with the principles of the present invention illustrating another spring clip arrangement that may be employed in conjunction with the unit of FIGS. 1 and 2.

Referring to FIG. 3, an alternative spring clip arrangement is illustrated for holding the material 4 of bag 3 against the toughened surface 12. The spring clip arrangement of FIG. 3 is similar to a mouse trap in which a spring 36 encircles a rod 37 which is formed into a U-shape member having a portion 38 bearing against the material 4 and toughened surface 12. Portion 38 is placed under spring tension by an extension 39 of spring 36 with the other end 40 of spring 36 being anchored or otherwise secured to the outer surface of jaw 1. The spring tension of portion 38 on material 4 can be released by raising portion 38 of this clip arrangement either by the fingers or by a member added thereto for lifting this spring clip arrangement.

While I have described above the principles of my invention in connection with specific apparatus, it is to be clearly understood that this description is made only by way of example and not as a limitation to the scope of my invention as set forth in the objects thereof and in the accompanying claims.

I claim:

1. An animal waste pickup and disposal unit comprising:

a pair of opposed jaws each having a gripping edge movable toward each other;

a plastic bag removably disposed between said pair of jaws having material adjacent an open end thereof folded back over an outer surface of said pair of jaws;

a pair of spring clips to releasably secure said material of said plastic bag to said outer surface of said pair of jaws, each of said pair of spring clips being disposed on said outer surface of an associated one of said pair of jaws and having at least a portion thereof adjacent said gripping edge of said associated one of said pair of jaws and substantially parallel to and coextensive with said gripping edge of said associated one of said pair of jaws;

an elongated handle; and a mechanism secured to each of said pair of jaws and said handle to bias said pair of jaws in an open position and to activate each of said pair of jaws to enable said gripping edges to pickup animal waste and to deposit the same in said plastic bag for disposal at a later time.

2. A unit according to claim 1, further including a roughened surface on said outer surface of each of said pair of jaws underlying said portion of an associated one of said pair of spring clips to prevent said plastic bag from slipping from under said portion of said associated one of said spring clips when said unit is in use.

3. A unit according to claim 2, wherein said mechanism includes a scissor mechanism connected between each of said pair of jaws and an adjacent end of said handle to enable movement of said pair of jaws to pickup said animal waste, an actuating rod connected between said scissor mechanism and an actuator disposed adjacent an end of said handle remote from said scissor mechanism to operate said scissor mechanism, and a biasing spring disposed about said actuating rod adjacent said scissor mechanism to bias said pair of jaws in said open position.

4. A unit according to claim 1, wherein said mechanism includes a scissor mechanism connected between each of said pair of jaws and an adjacent end of said handle to enable movement of said pair of jaws to pickup said animal waste, an actuating rod connected between said scissor mechanism and an actuator disposed adjacent an end of said handle remote from said scissor mechanism to operate said scissor mechanism, and a biasing spring disposed about said actuating rod adjacent said scissor mechanism to bias said pair of jaws in said open position.

5. A unit according to claim 1, further including a baffle member secured to one of said pair of jaws parallel to, substantially coextensive with and spaced from said gripping edge of said one of said pair of jaws, said baffle member extending toward but spaced from the other of said pair of jaws impinging upon an associated portion of said plastic bag to enable picking up and depositing in said plastic bag a plurality of animal waste without previously picked up and deposited animal waste falling out of said plastic bag, said picked up animal waste being deposited in said plastic bag on a side of said baffle member remote from said open end of said plastic bag.

6. A unit according to claim 5, further including a roughened surface on said outer surface of each of said pair of jaws underlying said portion of an associated one of said pair of spring clips to prevent said plastic bag from slipping from under said associated one of said spring clips when said unit is in use.

7. A unit according to claim 6, wherein said mechanism includes a scissor mechanism connected between each of said pair of jaws and an adjacent end of said handle to enable movement of said pair of jaws to pickup said animal waste, an actuating rod connected between said scissor mechanism and an actuator disposed adjacent an end of said handle remote from said scissor mechanism to operate said scissor mechanism, and a biasing spring disposed about said actuating rod adjacent said scissor mechanism to bias said pair of jaws in said open position.

8. A unit according to claim 5, wherein said mechanism includes a scissor mechanism connected between each of said pair of jaws and an adjacent end of said handle to enable movement of said pair of jaws to pickup said animal waste, an actuating rod connected between said scissor mechanism and an actuator disposed adjacent an end of said handle remote from said scissor mechanism to operate said scissor mechanism, and a biasing spring disposed about said actuating rod adjacent said scissor mechanism to bias said pair of jaws in said open position.

* * * * *